US005158236A

United States Patent [19]

Sugiyama et al.

[11] Patent Number: 5,158,236

[45] Date of Patent: Oct. 27, 1992

[54] ELECTROMAGNETIC FUEL INJECTION VALVE

[75] Inventors: Katuya Sugiyama, Anjo; Akio Kuromiya, Nagoya; Satoshi Sugiyama, Kariya; Yuji Inoue, Hino; Hideto Takeda, Kariya; Shinji Sugiura, Hekinan, all of Japan

[73] Assignee: Nippondenso Co., Ltd., Kariya, Japan

[21] Appl. No.: 543,871

[22] Filed: Jun. 26, 1990

[30] Foreign Application Priority Data

Jun. 26, 1989 [JP] Japan ..... 1-163574
Apr. 4, 1990 [JP] Japan ..... 2-88341

[51] Int. Cl.[5] ..... F02M 51/06

[52] U.S. Cl. ..... 239/585.1; 239/585.4; 251/129.15; 251/129.01; 29/602.1

[58] Field of Search ..... 239/585; 251/129.15, 251/129.01; 29/602.1

[56] References Cited

U.S. PATENT DOCUMENTS 4,597,558 7/1986 Hafner et al. ..... 251/129.15
4,704,591 11/1987 Hafner ..... 251/129.15
4,717,080 1/1988 Sauer ..... 239/585
4,798,188 1/1989 Ito et al. ..... 239/585
4,863,143 9/1989 Cowley et al. ..... 29/602.1
4,875,658 10/1989 Asai ..... 251/129.15

FOREIGN PATENT DOCUMENTS 55-29725 7/1980 Japan .
56-6062 1/1981 Japan .
59-63359 4/1984 Japan .
1275719 5/1972 United Kingdom ..... 239/585

*Primary Examiner*—Andres Kashnikow
*Assistant Examiner*—Christopher G. Trainor
*Attorney, Agent, or Firm*—Cushman, Darby & Cushman

[57] ABSTRACT

An electromagnetic fuel injection valve for an internal combustion engine having a housing which houses a valve, a needle valve element, a movable core, an electromagnetic actuator and spacer. The housing is made of magnetic material forms a magnetic flux circuit with the electromagnetic actuator and the movable core. The cylindrical housing is made of a plate material which comprises a portion facing the movable core, and the portion has a substantially minimum thickness to actuate the movable core.

22 Claims, 6 Drawing Sheets

ELECTROMAGNETIC FUEL INJECTION VALVE

BACKGROUND OF THE INVENTION

The present invention relates to an electromagnetic fuel injection valve for use in an internal combustion engine.

The conventional typical electromagnetic fuel injection valve has structure and shape shown in FIG. 7.

A solenoid coil 4 is disposed in a housing made of magnetic material. A stationary core 3 made of magnetic material is inserted into the solenoid coil 4. A movable core 2 made of magnetic material is positioned so as to face the stationary core 3. The movable core 2 is urged by a spring 7 and the preset load of the spring 7 is adjusted by the position of an adjusting pipe 8. Further, the movable core 2 is electromagnetically driven by the solenoid coil 4 and integrally connected with a needle valve 5 which is slidally fitted in a valve housing 6 so as to control the injection of a fuel in cooperation with a seat 6a formed within the housing 6.

In the above-described structure, the housing 1 is required to have a complicated shape since it receives therein the valve housing 6, solenoid coil 4 and the like while performing its function as one of elements of a magnetic circuit.

To satisfy such requirement, it has been usual that the housing 1 which is made of a ferromagnetic material such as 12Cr electromagnetic stainless steel is manufactured in such a manner that it is roughly molded to a predetermined shape by cold forging and fitting sections and insert holes of the housing requiring precision are finished by cutting thereby reducing the material and working costs.

However, in the case of cold forging, the shapes to which the housing is molded are limited. Especially, as the housing is required to have a jutted portion 1b facing the movable core 2 which is an important element in forming the magnetic circuit, it has been usual that the molding shape is restricted and as a result, a considerable amount of cutting has to be performed which leads to a large loss of material yield and an increase in the cost required for cutting.

SUMMARY OF THE INVENTION

In view of the above circumstances, an object of the present invention is to provide an electromagnetic fuel injection valve which can be easily manufactured without reducing its magnetic characteristic.

An electromagnetic fuel injection valve in the present invention has a housing which houses a valve housing, a needle valve element, a movable core, an electromagnetic actuator and spacer means, the housing is made of magnetic material so as to form a magnetic flux circuit with the electromagnetic actuator and movable core, the housing has a portion facing the movable core. The portion facing the movable core has a substantially minimum thickness enough to actuate the movable core from an open position to a closed position.

DETAILED DESCRIPTION OF THE PREFERRED EMBODIMENTS

The present invention will now be described on the basis of experiments and investigations conducted by the present inventors.

Figure 8:
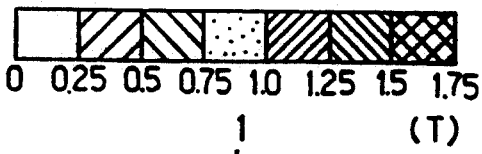
FIG. 8 is a characteristic chart showing an analysis of a dynamic magnetic field of the valve of FIG. 7.
Figure 8:
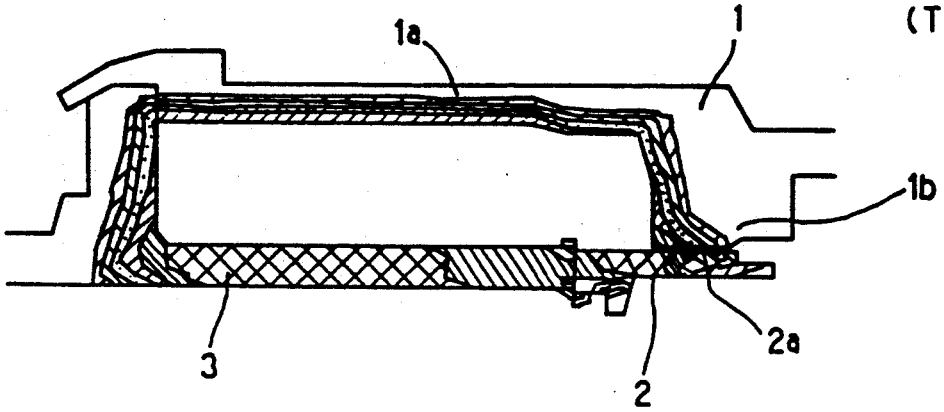

FIG. 8 shows results of a dynamic magnetic field analysis of a magnetic circuit of a conventional fuel injection valve in which the density distribution of the flow of magnetic flux is shown by a contour line. It will be seen from this figure that the flow of magnetic flux concentrates on a portion of about 1 mm in width from the innermost side of the outer periphery 1a of the housing while the outer side thereof has almost nothing to do with the magnetic flux flow. This is due to a skin effect resulting from an eddy current and similarly, it may safely be judged that even at the jutted portion 1b facing the side surface 2a of the movable core 2, the magnetic flux flow may well be of a width of 1-1. 5 mm along the inner surface of the jutted portion 1b although the entire area of the portion la facing the movable core 2 makes a magnetic path.

One embodiment of the present invention will now be described by referring to the accompanying drawings.

Figure 1:
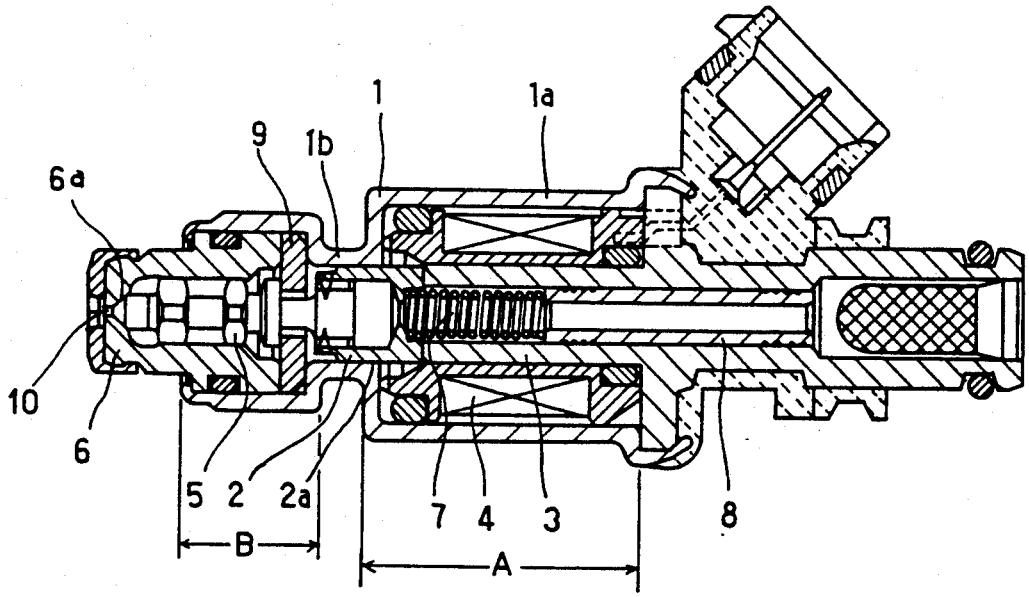
FIG. 1 is a sectional view of the entire structure of one embodiment of the present invention.

In FIG. 1, within the housing 1 made of magnetic material, there are received a valve housing 6, a needle valve 5 slidable within the valve housing 6, the movable core 2 made of magnetic material and connected to the needle valve 5, a magnetic stationary core 3 arranged opposite to the movable core 2, a solenoid coil 4 arranged around the stationary core 3, a spring 7 disposed within the stationary core 3 so as to urge the movable core 2 and an adjusting pipe 8 for adjusting the preset load of the spring 7 applied on the movable core 2.

With the above structure, when an electric current is supplied to the solenoid coil 4, a magnetic circuit is formed so that the movable core and the needle valve 5 is attracted against the urging force of the spring 7. As a result, the top end of the needle valve 5 leaves away from a seat 6a of the valve housing 6, a fuel supplied through the adjusting pipe 8 is injected from a fuel injection hole 10.

The housing 1 is made of a ferromagnetic material such as 13Cr electromagnetic stainless steel and has the jutted portion 1b facing the side surface 2a of the movable core 2 so as to provide the magnetic circuit around the solenoid coil 4 between the stationary and movable cores 3 and 2, so that it has a uniform thickness almost over the entire length thereof ranging from a solenoid receiving section A up to a valve receiving section B.

Figure 3:
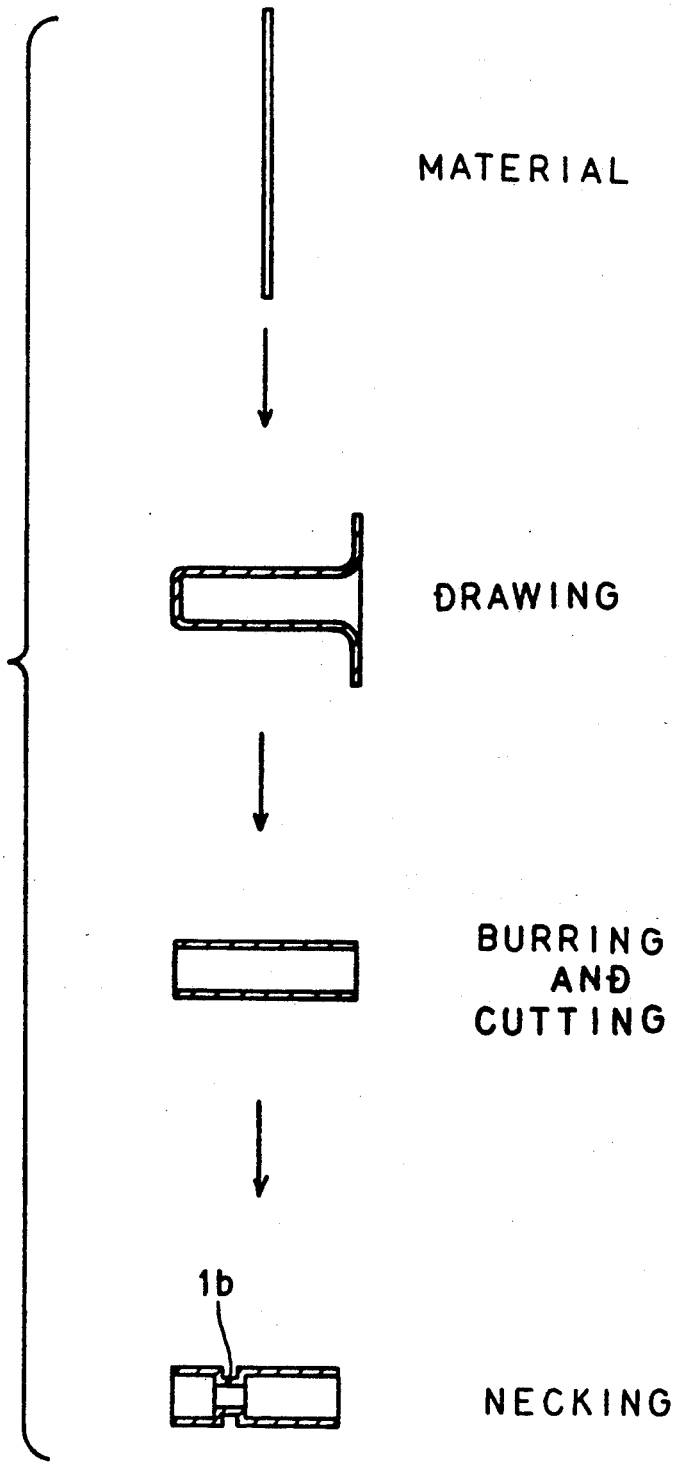
FIG. 3 is an illustration of a manufacturing process for a housing 1 of the embodiment of FIG. 1.
Figure 4:
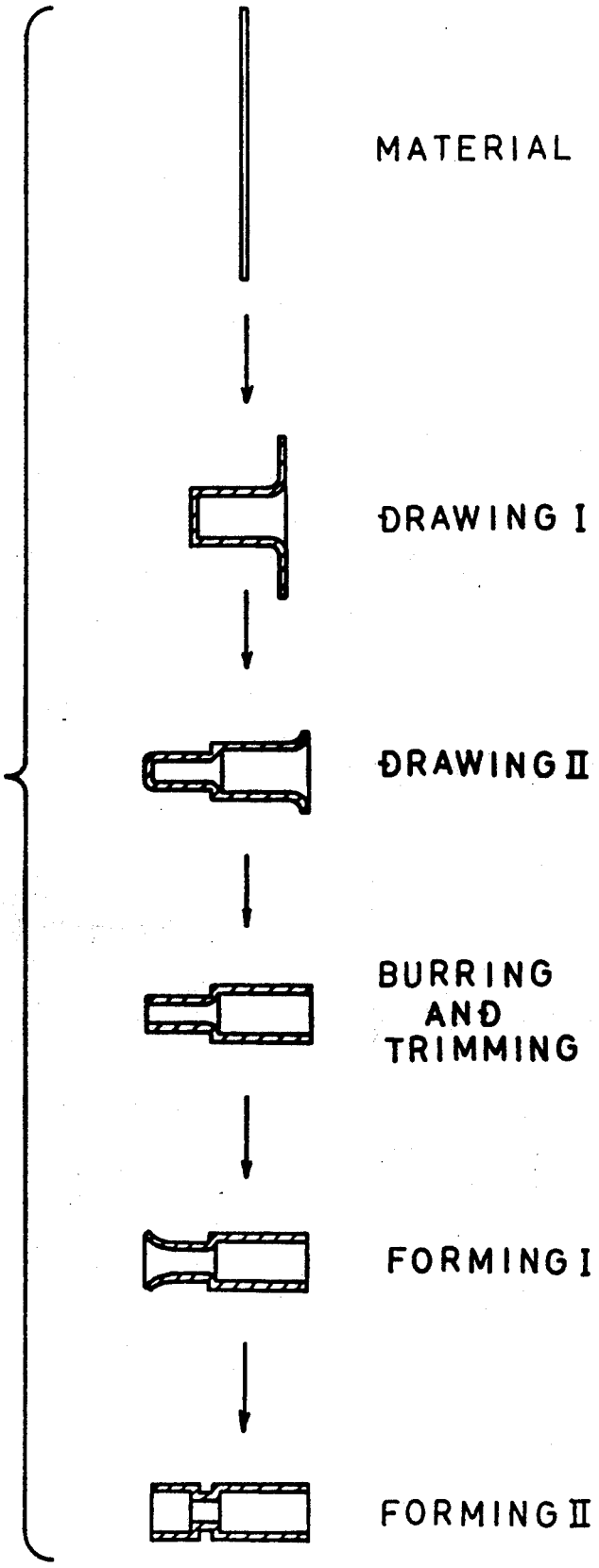
FIG. 4 is an illustration of another process of manufacturing the housing 1 of the embodiment of FIG. 1.

As illustrated by cross-referencing FIGS. 1 and 3, the housing 1 is manufactured in such manner that after a plate material is drawn sequentially by a press forming, it is shaped to a pipe by burring and cutting and the jutted portion 1b is formed by necking. The inner surface of the jutted portion 1b serves as a seat for the valve housing 6 through a spacer 9 and the outer surface thereof serves as a working criterion when the valve section comprising the valve housing 6 and the needle valve 5 is made integral with the housing 1 by caulking.

Figure 2:
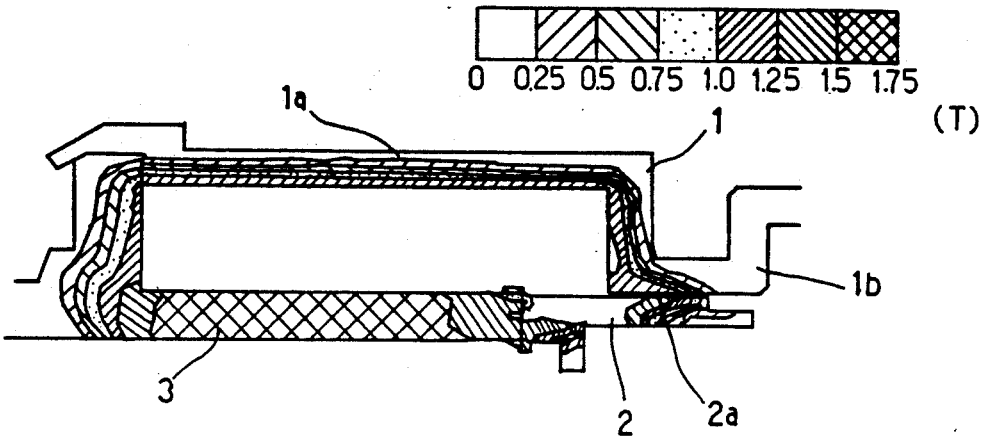
FIG. 2 is a characteristic chart showing an analysis of a dynamic magnetic field of the embodiment of FIG. 1.

FIG. 2 shows result of a dynamic magnetic field analysis of a magnetic circuit of an electromagnetic fuel injection valve using the housing 1 in which the magnetic flux flow distribution is expressed by a contour line. As will be clear from FIG. 2, even when both of the outer periphery 1*a* of the housing 1 and the jutted portion 1*b* are thinned altogether, that is, when the thickness of the housing is determined to be in the order of 1-1.5 mm over the entire length thereof, the magnetic flux flow is not at all hindered.

Figure 7:
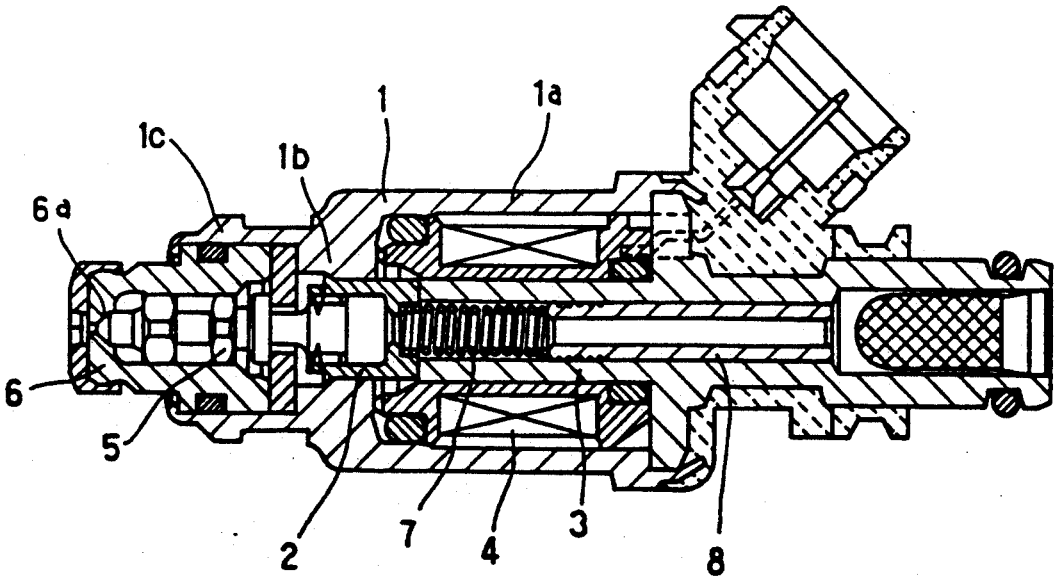
FIG. 7 (PRIOR ART)
FIG. 7 is a sectional view of the entire structure of a prior art valve.

Thus, according to the instant embodiment, the cold forging which has previously been required especially for the jutted portion 1*b* facing the movable core 2 is no more required since the housing 1 is made to have a uniform thickness over the entire length thereof and so the housing 1 can be manufactured from a thin plate material by drawing using a press working and necking using rollers. Further, with the above structure, it is sufficient to apply a small amount of working only on both ends and the inner surface of the housing 1 and unlike the conventional working method in which the projection designated by reference numeral 1*c* in FIG. 7 is provided by external cutting so as to serve as a working criterion for caulking the valve housing, the outer surface of the jutted portion 1*b* in FIG. 1 can serve as such criterion whereby the material yield can be greatly improved to sharply reduce the material and cutting costs.

It should be noted that although the jutted portion 1*b* of the housing 1 of the instant embodiment has been described to be able to be molded by necking, it is also possible to mold it to a shape having a pressed step by continuous drawing. Further, where the number of molding steps is reduced, it is also possible to mold a pipe material in such a manner that only the jutted portion 1*b* is formed by necking using rollers or by using a mold in the right to the axis of the material.

Further, in order to improve the strength of the jutted portion 1*b*, a reinforcing member is arranged around that portion or a rib may be formed on the outer periphery thereof.

Figure 5:
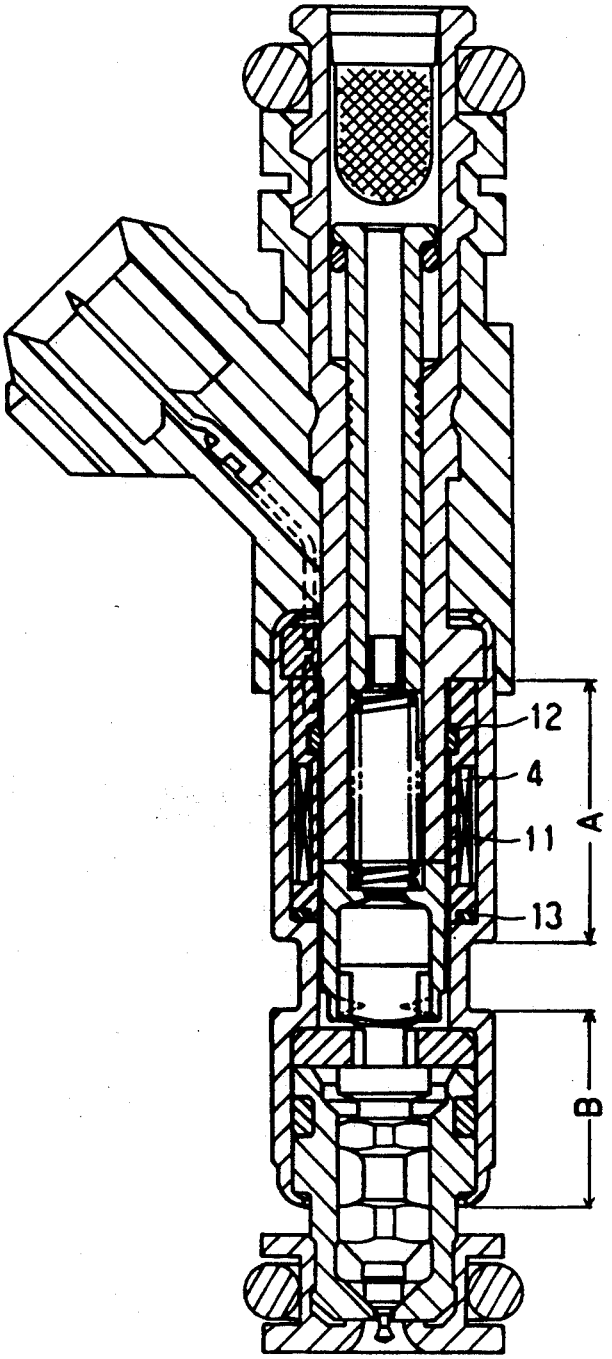
FIG. 5 is a sectional view of the entire structure of another embodiment of the present invention.
Figure 6:
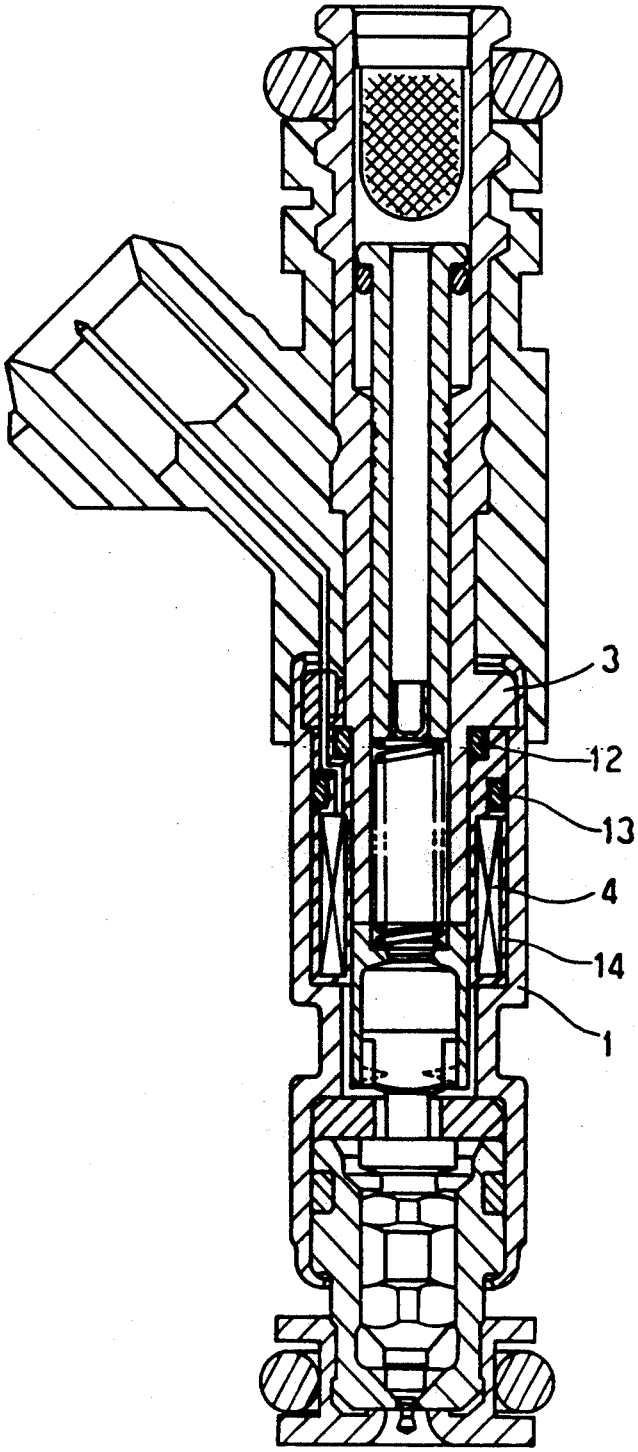
FIG. 6 is a sectional view of the entire structure of still another embodiment of the present invention.

In the instant embodiment, a typical example has been given in which the outer diameter of the solenoid receiving section A and that of the valve receiving section B are different from each other but the housing may have the same outer diameter over the entire length thereof as shown in FIG. 5 so that the molding process is more simplified and a more favorable result is obtained in point of economy. Further, in the instant embodiment, the above-mentioned solenoid receiving section A and the valve receiving section B are made to have the same outer diameter by reducing the thickness of the solenoid coil 4 in the radial direction.

In addition, if the radial thickness of the solenoid 4 of FIG. 5 is reduced, the thickness of a synthetic resin spool 11 serving as a coil retainer will also reduce resulting in a sharp decrease in the rigidity of the spool. Further, by the reduction of the volume of the solenoid coil 4, the solenoid coil is liable to be heated to an high temperature so that the rigidity of the spool 11 made of a synthetic resin material is weakened and especially an O-ring 12 which is not firmly supported by the stationary iron core 3 and which tends to deform by creeping. Consequently, it becomes difficult to secure the fuel sealing state at the O-ring 12. Therefore, in the instant embodiment of FIG. 5, the spool 11 around which the solenoid coil 4 is wound and an outer cover 14 of the solenoid 4 are provided with grooves, respectively, and the first O-ring 12 and a second O-ring 13 are embedded in these grooves, respectively. That is, by so doing, the second O-ring 13 is supported by the housing 1 so that even when the solenoid coil is heated to a high temperature, the oil sealing property of the O-ring 13 can be maintained securely.

In the instant embodiment, the spool 11 is first molded, the solenoid coil 4 is wound around the spool 11 and then the cover 14 is molded. In this case, a portion 15 below the spool 11 and the cover 14 may be bonded by welding, supersonic welding, adhesion and etc.

What is claimed is:

1. An electromagnetic fuel injection valve for injecting fuel for use in an internal combustion engine comprising:

a valve housing having an injecting port;

a needle valve element slidably disposed within said valve housing for opening and closing said injecting port;

a movable core connected to said needle valve;

an electromagnetic actuator for actuating said movable core and said needle valve element between an open position and a closed position;

spacer means for limiting said open position of said needle valve element; and a cylindrical housing, made of a magnetic material, for directly covering at least said electromagnetic actuator and said movable core, and having a substantially uniform and restricted thickness over its entire length so as to form a magnetic flux circuit in which a sufficient magnetic flux flows from said actuator through said cylindrical housing to said movable core so as to actuate said movable core.

2. An electromagnetic fuel injection valve according to claim 1, wherein said cylindrical housing is formed from a thin plate material by a press working.

3. An electromagnetic fuel injection valve according to claim 2, wherein said press working comprises a drawing step, a burring step and a cutting step.

4. An electromagnetic fuel injection valve according to claim 1, wherein said cylindrical housing comprises a first portion which houses said valve housing and said spacer means, and a second portion which houses said movable core, an outer diameter of said second portion being smaller than the outer diameter of said first portion.

5. An electromagnetic fuel injection valve according to claim 4, wherein said cylindrical housing is formed from a thin plate material by a press working, and said press working comprises a drawing step, a burring step, a cutting step and necking step.

6. An electromagnetic fuel injection valve according to claim 1, wherein said cylindrical housing comprises first, second, and third portions which house said valve housing, movable core and electromagnetic actuator, respectively, an outer diameter of said second portion being smaller than outer diameters of said first portion and said third portion.

7. An electromagnetic fuel injection valve according to claim 6, wherein said cylindrical housing is formed from a thin plate material by a press working, and said press working comprises a drawing step, a burring step, a cutting step and necking step.

8. An electromagnetic fuel injection valve according to claim 6, wherein said the diameter of said first portion is equal to the outer diameter of said third portion.

9. An electromagnetic fuel injection valve according to claim 1, wherein the thickness of said portion which faces said movable core is in a range of 1-1.5 mm.

10. An electromagnetic fuel injection valve according to claim 1, wherein said electromagnetic actuator comprises a stationary core, a solenoid coil wound around said stationary core and spool member made of insulating material and wound around said stationary core.

11. An electromagnetic fuel injection valve according to claim 10, further comprising:

a first sealing member disposed between said spool member and said stationary core; and a second sealing member disposed between said spool member and said cylindrical housing.

12. An electromagnetic fuel injection valve according to claim 1, wherein said electromagnetic actuator comprises:

a stationary core, a solenoid coil wound around said stationary core, and a covering member made of insulating material and covering said solenoid coil.

13. An electromagnetic fuel injection valve according to claim 12, said electromagnetic actuator further comprising:

an elongated portion extending from said covering member having an inner groove and an outer groove,, a first O-ring disposed in said inner groove for sealing between said elongated portion and said stationary core, and a a second O-ring disposed in said outer groove for sealing between said elongated portion and said cylindrical housing.

14. An electromagnetic fuel injection valve for injecting fuel for use in an internal combustion engine comprising:

a valve housing having an injecting port;

a needle valve element slidably disposed within said valve housing for opening and closing said injecting port;

a movable core connected to said needle valve element;

an electromagnetic actuator for actuating said movable core and said needle valve element between an open position and a closed position;

spacer means for limiting said open position of said needle valve element; and a cylindrical housing, made of a magnetic material, having a valve receiving section which houses said valve housing and said needle valve element, a concave portion which directly faces said movable core and an actuator receiving section which houses an electromagnetic actuator, a thickness of said valve receiving section, said concave section and said actuator receiving section being substantially uniform and restricted over its entire length so as to form a magnetic flux circuit in which a sufficient magnetic flux flows from said actuator, through said cylindrical housing, to said movable core so as to actuate said movable core.

15. An electromagnetic fuel injection valve according to claim 14, wherein the outer diameter of said concave portion is smaller than the outer diameter of said valve receiving section.

16. An electromagnetic fuel injection valve according to claim 14, wherein the outer diameter of said concave portion is smaller than the outer diameter of said actuator receiving section.

17. An electromagnetic fuel injection valve according to claim 14, wherein the outer diameter of said valve receiving section is equal to the outer diameter of said actuator receiving section.

18. An electromagnetic fuel injection valve according to claim 14, wherein said thickness of said jutted portion which faces said movable core is in a range of 1-1.5 mm.

19. An electromagnetic fuel injection valve according to claim 14, wherein said electromagnetic actuator comprises a stationary core, a solenoid coil wound around said stationary core and spool member made of insulating material and wound around said stationary core.

20. An electromagnetic fuel injection valve according to claim 19, further comprising:

a first sealing member disposed between said spool member and said stationary core; and a second sealing member disposed between said spool member and said cylindrical housing.

21. An electromagnetic fuel injection valve according to claim 14, wherein said electromagnetic actuator comprises a stationary core disposed in a center of said actuator receiving section, a solenoid coil wound around said stationary core, and covering member made of insulating material and covering said solenoid coil.

22. An electromagnetic fuel injection valve according to claim 21, said electromagnetic actuator further comprising:

an elongated portion elongated from said covering member to a space between said stationary core and said cylindrical housing, said elongated portion having an inner groove and an outer groove, a first O-ring disposed in said inner groove for sealing between said elongated portion and said stationary core, and a second O-ring disposed in said outer groove for sealing between said elongated portion and said cylindrical housing.

* * * * *